US005575890A

United States Patent [19]

Prough et al.

[11] Patent Number: 5,575,890

[45] Date of Patent: Nov. 19, 1996

[54] METHOD FOR SELECTIVELY INCREASING THE SULFIDE ION CONCENTRATION AND SULFIDITY OF KRAFT COOKING LIQUOR DURING KRAFT COOKING OF WOOD

[75] Inventors: J. Robert Prough, Queensbury; Bruno S. Marcoccia, South Glens Falls; Richard O. Laakso, Queensbury; Carl L. Luhrmann, Glens Falls, all of N.Y.

[73] Assignee: Kamyr, Inc., Glens Falls, N.Y.

[21] Appl. No.: 291,918

[22] Filed: Aug. 18, 1994

Related U.S. Application Data

[63] Continuation-in-part of Ser. No. 148,269, Nov. 8, 1993, Pat. No. 5,536,366, which is a continuation-in-part of Ser. No. 127,548, Sep. 28, 1993, Pat. No. 5,547,012, which is a continuation-in-part of Ser. No. 56,211, May 4, 1993, Pat. No. 5,489,363.

[51] Int. Cl.[6] ..... D21C 3/26

[52] U.S. Cl. ..... 162/34; 162/39; 162/43; 162/45

[58] Field of Search ..... 162/19, 34, 38, 162/39, 29, 86, 43, 45

[56] References Cited

U.S. PATENT DOCUMENTS 5,326,433 7/1994 Ryham et al. ..... 162/14

FOREIGN PATENT DOCUMENTS 476230 5/1991 European Pat. Off. .
517689 5/1992 European Pat. Off. .
WO94/25668 11/1994 WIPO .
WO96/02698 2/1996 WIPO .

OTHER PUBLICATIONS

Hartler, N., "Extended Delignification . . . Concept", Svensk Pappersidning 15:483 (1978), pp. 1–2.
Greenwood, "Continuous Digesters", Kamyr, Inc., Bulletin No. KGD1815–RW491, Apr. 1991.

*Primary Examiner*—Donald E. Czaja
*Assistant Examiner*—Dean T. Nguyen
*Attorney, Agent, or Firm*—Nixon & Vanderhye P.C.

[57] ABSTRACT

The sulfide ion concentration and sulfidity of kraft cooking liquor during kraft cooking of cellulose pulp is selectively increased. After treatment in a first treatment zone in which impregnation or kraft cooking takes place using a kraft cooking liquor having a first sulfide ion concentration and sulfidity, black liquor is extracted from the material, liquid is withdrawn from the material and dilution liquid is added to the withdrawn liquid and the withdrawn liquid with dilution liquid is reintroduced. In a second treatment zone after the first zone a second kraft cooking liquor is introduced having a second sulfide ion concentration and sulfidity greater than the first sulfide ion concentration and sulfidity (typically by about 20–50%), including by manipulating controlling the flow rate of extraction and the flow rates of withdrawal of liquid and addition of dilution liquid. The pressure of the continuous digester is controlled in a unique manner that avoids disruptions to the column of pulp continuously moving downwardly in the digester, anywhere in the digester, but particularly avoids non-uniform, unstable material in the countercurrent washing zone. The pressure is controlled by withdrawing liquid from, and introducing liquor into, the digester at at least one additional extraction-dilution loop aside from the main extraction of the digester and the wash dilution liquid introduction mechanism below the wash screens. Pressure can also be maintained (e.g. at about 130–170 psi) by also controlling the amount of wash dilution liquor, and by varying the extraction flow.

14 Claims, 4 Drawing Sheets

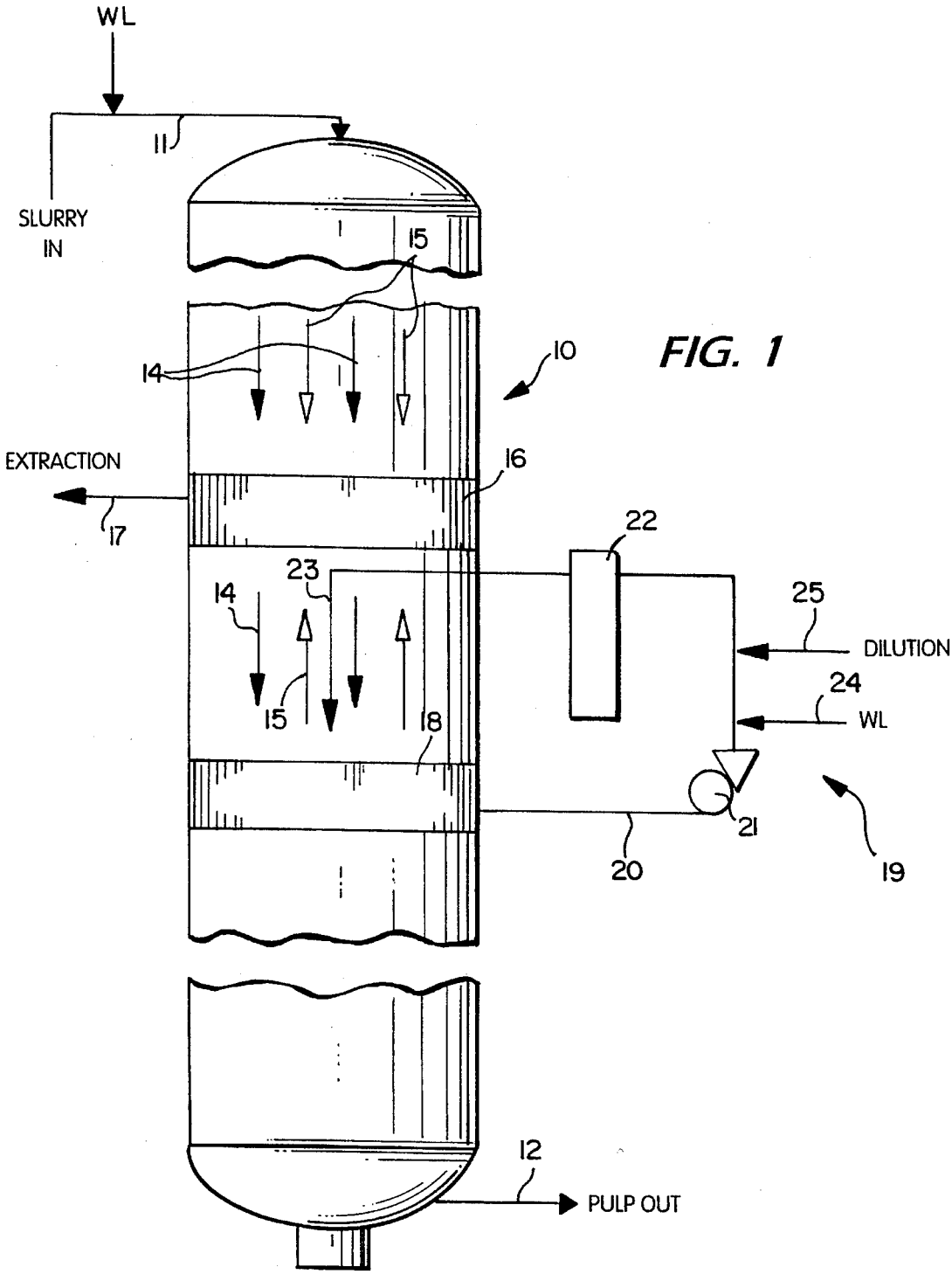
FIG. 1
FIG. 2A
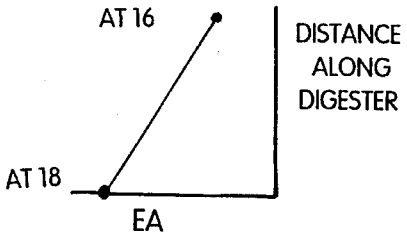
FIG. 2B
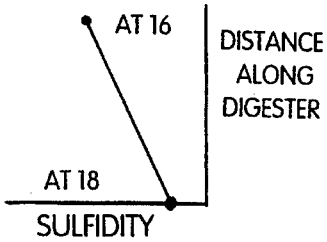

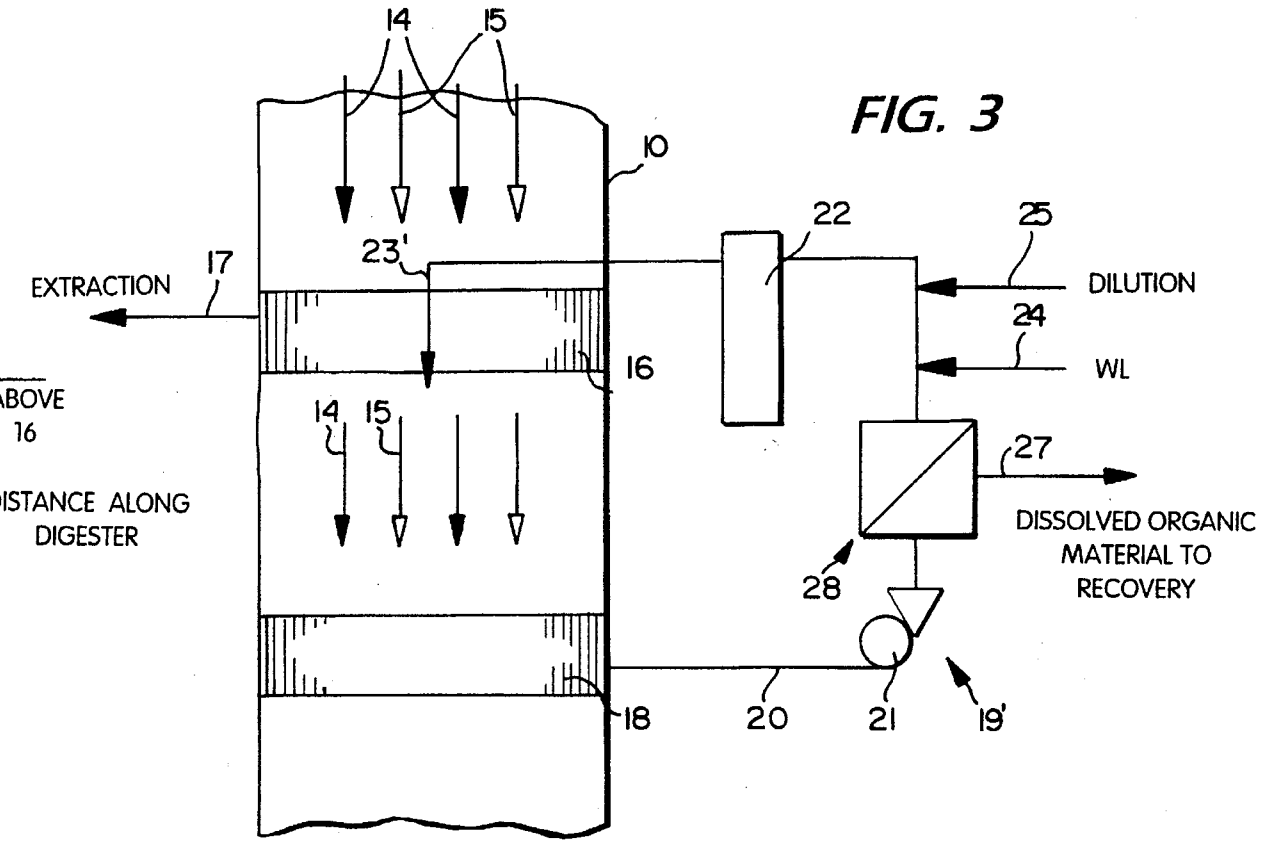
FIG. 3
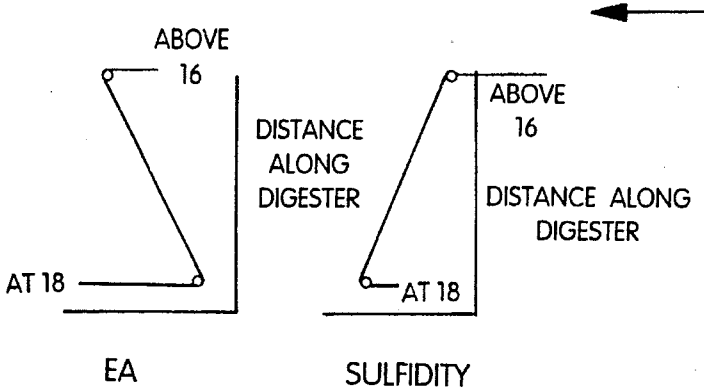
FIG. 4A
FIG. 4B

METHOD FOR SELECTIVELY INCREASING THE SULFIDE ION CONCENTRATION AND SULFIDITY OF KRAFT COOKING LIQUOR DURING KRAFT COOKING OF WOOD

This application is a continuation-in-part of application Ser. No. 08/148,269, filed Nov. 8, 1993, now U.S. Pat. No. 5,536,366, which in turn is a continuation-in-part of application Ser. No. 08/127,548, filed Sep. 28, 1993, now U.S. Pat. No. 5,547,012, which in turn is a continuation-in-part of appliction Ser. No. 08/056,211, filed May, 4, 1993, now U.S. Pat. No. 5,489,363.

BACKGROUND AND SUMMARY OF THE INVENTION

In the parent applications, a unique technique for enhancing kraft cooking is provided utilizing one or more circulation-dilution loops in addition to conventional extraction and dilution mechanisms, and by reintroducing liquor having lower dissolved organics (such as dissolved cellulose, lignin and hemicellulose) than the withdrawn liquor. It has now been found, according to the present invention, that the same basic technique of additional circulation-dilution loops can be utilized to perform other worthwhile functions. In particular, according to the present it has been found that a method—utilizing the additional circulation/dilution loops—for selectively increasing the sulfidity and sulfide ion concentration of the kraft cooking liquor (e.g. white liquor) during kraft cooking of comminuted cellulose fibrous material (wood chips) may be provided, which is especially advantageous at or near the impregnation and/or first cooking zones. It has also been found according to the present invention that such additional circulation-dilution loops can be utilized to maintain the pressure in the digester at a desired superatmospheric level (e.g., the conventional level of about 165 psi) or maintain the liquor level in a manner that avoids non-uniform unstable material movement in the countercurrent washing zone, and—depending upon the particulars of the method—anywhere in the digester.

The active cooking chemicals in kraft cooking liquor, e.g. white liquor, are sodium hydroxide, NaOH, and sodium sulfide, $Na_2S$. In an aqueous medium these chemicals hydrolyze based upon the following reactions $$NaOH+H_2O \rightarrow Na^+ + OH^- + H_2O$$

$$Na_2S+H_2O \rightarrow 2Na^+ + OH^- + HS^-$$

The resulting active ions that are significant to kraft cooking are the hydroxyl ions, $OH^-$, and the hydrosulfide ions, $HS^-$. The actual role of these ions are quite different. The hydroxyl ion attacks both the cellulose components of the wood and the lignin. It is believed that the hydrosulfide enhances the hydroxyl ions reaction with the lignin to improve lignin removal, or delignification.

During the cooking process, especially continuous processes, the concentration of hydroxyl ions, or effective alkali (EA), is reduced as the cooking process proceeds. That is, the hydroxyl ions are consumed during the pulping process while the hydrosulfide ion is essentially unaffected.

In the early 1980's, in studies performed at the Swedish Royal Institute of Stockholm (STFI), Sjoblom and others showed that the presence of high concentrations of the hydrosulfide ion in the early stage of kraft cooking improved the resulting yield of the cook. Since that time, efforts have been made to increase the concentration of the hydrosulfide ion, or the sulfidity, of the cooking liquor by chemical addition or manipulation of the recovery process. Examples of such efforts are illustrated in co-pending U.S. application Ser. No. 07/918,855 filed Jul. 27, 1992 (Attorney Docket 30-199). The invention takes a much different approach. According to the invention there is provided a new process by which sulfide ion concentration and sulfidity can be enhanced without resorting to chemical addition or manipulation of recovery processes. The invention increases sulfide ion concentration and sulfidity at selected points in a digester by simply manipulating liquor flows.

According to a first aspect of the present invention a method of selectively increasing both the sulfidity and sulfide ion concentration of kraft cooking liquor during kraft cooking of comminuted cellulosic fibrous material is provided. The method comprises the steps of continuously: (a) In a first treatment zone in which impregnation or kraft cooking of comminuted cellulosic fibrous material takes place, causing the material in a slurry of kraft cooking liquor having a first sulfide ion concentration and sulfidity to flow in a first direction through the first zone, from the beginning of the first zone to the end of the first zone. (b) Extracting black liquor from the material at some point after the first treatment zone. (c) Also at some point after the first treatment zone, withdrawing liquid from the material, and adding dilution liquid to the withdrawn liquid, and re-introducing the withdrawn liquid with dilution liquid to the material. And, (d) in a second treatment zone after the first zone subjecting the material to a second kraft cooking liquor having a second sulfide ion concentration and sulfidity greater than the first sulfide ion concentration and sulfidity, including by manipulating and controlling the flow rate of extraction in step (b) and the flow rates of withdrawal of liquid and addition of dilution liquid in step (c).

In the method as described above, steps (b) through (d) are typically practiced so that the second sulfide ion concentration and sulfidity are at least about 20% greater than the first sulfide ion concentration and sulfidity, typically about 20–50% greater, and preferably about 30–40% greater. Also during the practice of step (c) desirably at least half of the dissolved organics are removed from the withdrawn liquor (e.g. by ultra-filtration) prior to re-introduction.

The first zone may be an impregnation zone of a continuous digester or in an impregnation vessel connected to a continuous digester. The first zone may be a vertical co-current cooking or impregnation zone above an extraction screen in a vertical continuous digester. Step (c) may then be practiced so that the reintroduced liquid flows primarily countercurrent to cellulosic material in a second zone in the vertical continuous digester, below the first zone; or step (c) may be practiced to reintroduce the liquid adjacent the beginning of a second co-current zone just below the extraction screen in the vertical continuous digester.

According to another aspect of the present invention a method of increasing the sulfide ion concentration and sulfidity of kraft cooking liquor during kraft cooking of comminuted cellulosic fibrous material comprises the following continuous steps: (a) In a first treatment zone in which impregnation or kraft cooking of comminuted cellulosic fibrous material takes place, causing the material in a slurry of kraft cooking liquor having a first sulfide ion concentration and sulfidity to flow in a first direction through the first zone, from the beginning of the first zone to the end of the first zone. (b) At the end of the first zone removing a substantial amount of the cooking liquor. (c) In a second zone, following the first zone, causing the material to flow counter-currently to the flow of cooking liquor. And, (d) at the beginning of the second zone introducing the material to a second cooking liquor having a higher (e.g. about 20–50%, preferably about 30–40%) sulfide ion concentration and sulfidity than the first liquor.

In a continuous digester the comminuted cellulosic material (chips) flow as a uniform "plug" within the digester. The expression "chip column movement" is often used to describe this flow. This preferred plug flow provides a relatively uniform matrix through which cooking liquor and wash liquor can pass. Although not common, operating conditions which deviate from the design conditions for a digester can cause non-uniformities or discontinuities in this chip matrix which may create areas in which liquor flow may not be uniform. Dislocations or breaks in the chip matrix may create areas in which liquor flow may not be uniform. Dislocations or breaks in the chip column may provide areas where liquor is not distributed uniformly and may result in liquor "channeling". Chips may also channel. Unstable chip columns may have areas where chip movement is not uniform. Chips may move faster in one region than in another.

When chip or liquor movement deviates from the ideal flow, non-uniformities in the cooking process and in the washing process may occur. White liquor which channels can preferentially cook chips adjacent to the channel while other chips are left partially cooked or undercooked. Wash liquor that channels decreases the washing efficiency and results in increased carry-over of dissolved solids and cooking chemicals to the downstream process.

Another aspect of the chip column that affects the uniformity of the cooking and washing process is the chip column "compaction". The weight of the chips and liquor above a section of chips ideally, uniformly compresses the chips so that uniform resistance to liquor flow occurs. If the chip column is not uniform, for example, if the chips are restrained by liquor flow out an extraction screen, i.e., "the hung digester", the chip compaction beneath the screen may be less than that further away from the screen. These areas of reduced compaction may provide regions of reduced resistance to liquor flow and promote liquor channeling.

The introduction of cooking or wash liquor at various locations in the digester may affect the desired uniformity of the chip column. In some situations, fluctuations in this introduction of liquor may further exacerbate the impact this liquor can have on the chip column uniformity and movement.

One liquor source to the digester is the wash flitrate introduction which is also used for pressure control (i.e., "PV-11" in conventional continuous hydraulic digesters, including MCC® and EMCC® digesters available from Kamyr, Inc.). The pressure within the digester is controlled by a closed-loop control to a specified value, typically 130–170 psi (e.g. about 165 psi). The pressure within the digester varies due to the amount of chips and liquor fed to the top of the digester, the amount of pulp blown from the digester, the amount of extraction flow removed, the amount of wash flitrate flow added, and other variables. The conventional preferred method of controlling the pressure is to increase or decrease the flow of liquor through valve PV-11. PV-11 is typically located below the wash screens in a Kamyr® digester and supplies pressurized wash liquor (i.e., "cold blow" liquor) from the downstream brownstock washers.

In some digesters, the vessel pressure is controlled by varying the extraction flow out of the vessel, but this is not a preferred method.

As noted previously, the fluctuation in PV-11 flow increases the potential to produce non-uniform, unstable chip movement and liquor flow. In particular, these non-uniformities are promoted in an area that is critical to the efficiency of the counter-current washing/cooking zone directly above. Fluctuations in PV-11 flow increase the potential to produce liquor channeling, non-uniform chip column movement and non-uniform compaction of the chip column.

According to a second aspect of the present invention, the pressure within a digester is controlled in a simple manner which avoids the problems of the control techniques described above, and in fact results in no disruptions of the column of pulp continuously moving downwardly in the digester anywhere within the digester. According to this aspect of the invention, a method of controlling the pressure of a vertical continuous comminuted cellulosic fibrous material digester having a countercurrent washing zone with wash screens, a main extraction, and at least one additional extraction-dilution loop distinct from the main extraction is provided, comprising the step of: (a) Withdrawing liquor from, and introducing liquor into, the digester at the at least one additional extraction-dilution loop to maintain the pressure in the digester at a desired superatmospheric level while avoiding non-uniform, unstable material movement in the countercurrent washing zone. Step (a) is typically practiced to maintain the pressure in the digester at about 130–170 psi (e.g. about 165 psi).

The digester also typically comprises a wash dilution liquid introduction mechanism below the wash screens. In this case there is preferably also the further step (b) of controlling the pressure in the vessel by also, in addition to step (a), controlling the amount of wash dilution liquid introduced into the digester by the wash dilution liquid introduction mechanism (e.g. PV-11). There may also be the further step (c), in addition to step (a), or in addition to steps (a) and (b), of controlling the pressure in the vessel by also varying the extraction flow out of the digester through the main extraction. Alternatively, the control of pressure in the digester, by manipulating liquid extractions and introductions, may consist of (that is be provided only by) the practice of step (a), although still there will be other variables which can control the pressure including the amount of chips and liquor fed to the top of the digester, etc., as described above.

At least two additional extraction-dilution loops may be provided, in which case step (a) may be practiced by varying the liquid flow into and out of the digester using at least two different extraction-dilution loops. The volume and location for introduction of pressure controlling liquid can be controlled to least-affect the column movement in the digester. The optimum volume and location will vary from digester to digester, depending upon which area in the digester has the most stable column movement. However in all cases the significant potential source of non-uniform liquor distribution and non-uniform column movement in the critical counter-current washing/cooking zone is minimized or eliminated.

According to another aspect of the present invention, a method of controlling the pressure of a vertical continuous digester is provided comprising the steps of: (a) withdrawing liquor from, and introducing liquor into, the digester at the at least one additional extraction-dilution loop to maintain the pressure in the digester at a desired superatmospheric level; and (b) controlling the pressure in the vessel by also, in addition to step (a), controlling the amount of wash dilution liquid introduced into the digester by the wash dilution liquid introduction mechanism; or (c) controlling the pressure in the vessel by also, in addition to step (a), varying the extraction flow out of the digester; step (a), and at least one of steps (b) and (c), being practiced to avoid disruptions of a column of pulp continuously moving downwardly in the digester anywhere in the digester.

Of course the selective sulfide ion concentration and sulfidity increasing aspect of the invention may be combined with the continuous digester pressure control aspect of the invention, so that the advantages of both are obtained in a continuous digester, and they both can be obtained at the same time utilizing the same circulation/extraction-dilution loop or loops.

It is the primary object of the present invention to increase the effectiveness and practicality of kraft cooking of comminuted cellulosic fibrous material in the production of cellulosic (paper) pulp. This and other objects of the invention will become clear from an inspection of the detailed description of the invention and from the appended claims.

BRIEF DESCRIPTION OF THE DRAWINGS

FIG. 1 is a schematic side view of an exemplary continuous digester utilizing the method of selectively increasing the sulfidity and sulfide ion concentration of kraft cooking liquor during kraft cooking, according to the present invention;

FIGS. 2A and 2B are schematic representations of the effective alkali (EA) and sulfidity of the liquor as it moves downwardly between the two screens in the digester of FIG. 1;

FIG. 3 is a view like that of FIG. 1 only for different types of digester flow;

FIGS. 4A and 4B are schematic representations of the effective alkali (EA) and sulfidity of the liquor as it moves downwardly between the two screens in the digester of FIG. 3;

DETAILED DESCRIPTION OF THE DRAWINGS

Figure 5:
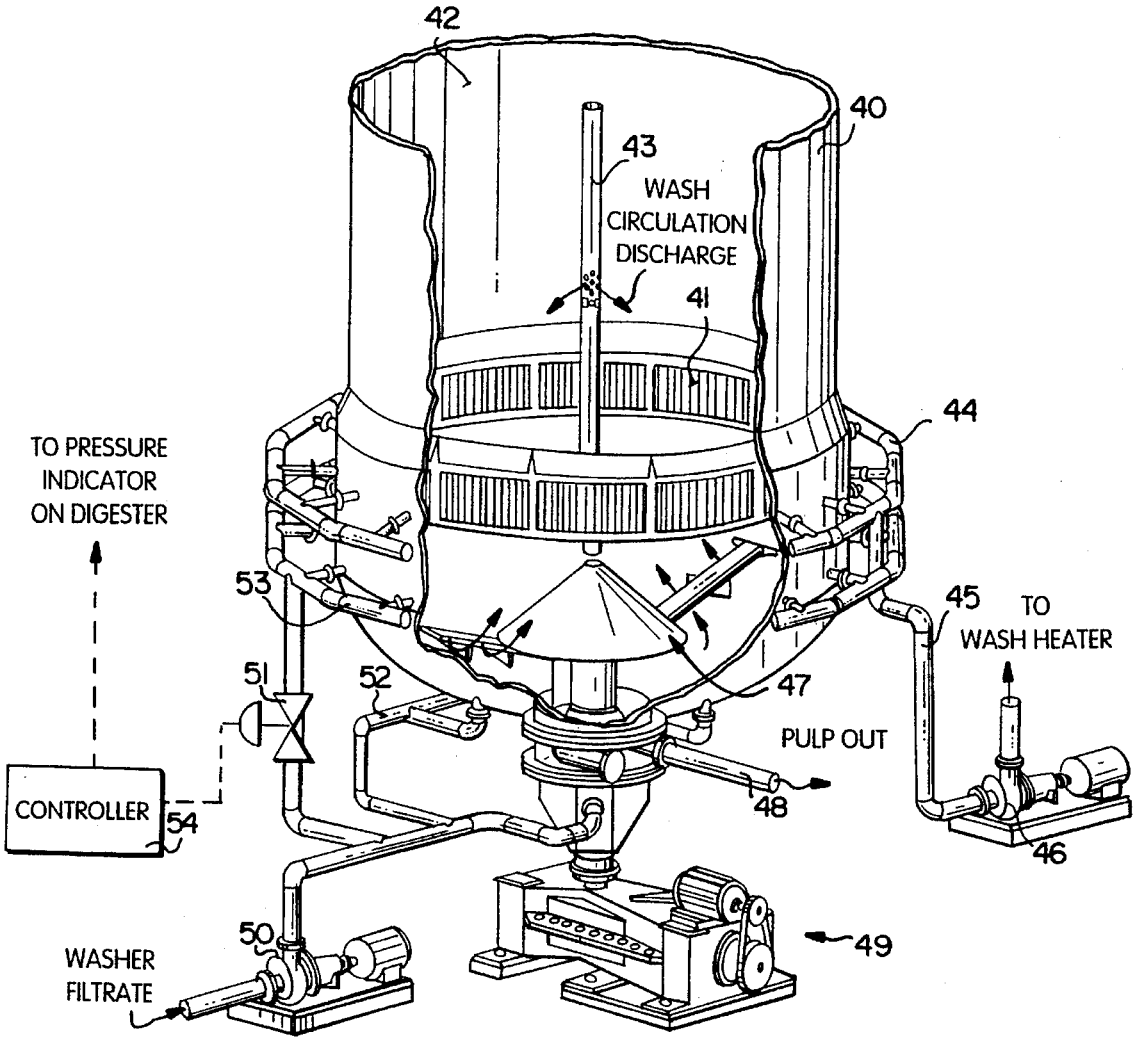
FIG. 5 (PRIOR ART)
FIG. 5 is a bottom detail perspective view, with portions of the digester shell cut away for clarity of illustration, of the most common pressure control mechanism in conventional Kamyr, Inc. continuous digesters.

FIGS. 1 through 4 schematically illustrate a method of selectively increasing the sulfidity and sulfide ion concentration of white liquor, or other kraft cooking liquor, during kraft cooking according to the present invention, as practiced in a continuous digester 10 (or continuous impregnation vessel). In the particular embodiment illustrated in FIG. 1 a counter-current cooking zone is provided. In the digester 10 (such as one available from Kamyr, Inc. of Glens Falls, N.Y.) a slurry of comminuted cellulosic fibrous material in white or black liquor (kraft cooking liquor), typically wood chips in white liquor, is introduced at the top as indicated by 11, while digested pulp is removed from the bottom as indicated by line 12. At upper stages of the vessel 10 the chips flow is indicated by solid head arrows 14 while free or unbound liquor flows as indicated by the blank arrow heads 15, that is, co-currently. A conventional extraction screen 16 is provided from which black liquor is extracted in line 17 at a controlled rate (e.g. by controlling pumps, valves, or other flow control devices as known per se). Above screen 16 is a first co-current impregnation or cooking zone.

A circulation/dilution loop screen 18 according to the present invention is provided below the extraction screen 16 in the FIG. 1 embodiment, and in the second zone between the screens 16, 18, counter-current cooking is provided, as indicated by the differently directed arrows 14, 15 therein. The entire loop 19 may be as described in the parent applications, any particular items of apparatus therein being utilizable in the loop 19. In the embodiment actually illustrated in FIG. 1 the loop 19 includes a withdrawal line 20 connected to the screen 18, a pump 21, a heater 22, and a reintroduction conduit 23 for reintroducing the withdrawn and heated liquor above the screen 18 (near the bottom of the second zone) to flow counter-currently—as indicated by arrows 15—to the extraction screen 16.

In the system of FIG. 1, the sulfide ion concentration in the black liquor is increased by first removing diluted weak black liquor through screen 16 by conduit 17. The liquor above screen 16 in the co-current impregnation/cooking (first) zone has been diluted by, among other things, the condensate introduced during chip steaming and by the moisture present in the original chips. The weak liquor is replaced by the relatively stronger liquor which passes counter-currently upward below screen 16 from the second zone. The amount of weak liquor displaced by the stronger liquor depends upon the extraction flow in line 17. The extraction in line 17 must exceed the flow of free liquor flowing co-currently above the screen 16 to ensure displacement of weak liquor by the stronger liquor.

At the same time, as the liquor below screen 16 flows counter-currently, the sodium hydroxide (alkali) in this liquor is consumed and the hydrogen sulfide is essentially unchanged. This consumption of alkali produces a liquor with low alkalinity yet still containing a sulfide content greater than the liquor above screen 16. As a result, the relative sulfide ion concentration of the liquor below screen 16 is essentially the same as the liquor introduced by conduit 23 but, more importantly, its alkalinity is lower than the liquor introduced by conduit 23. Thus, below screen 16 the chips are introduced to liquor having a high sulfide ion concentration but a low alkalinity. Liquor having the same sulfide ion concentration but a lower alkalinity (i.e., less $OH^-$) is, by definition, higher in "sulfidity". Thus, the desired cooking liquor in the second zone can be characterized as having a relatively high sulfide ion concentration and a high sulfidity, both at least about 20% higher (typically about 20–50%, and preferably about 30–40% higher) than in the first zone (above screen 16).

Though what has been described above is essentially MCC® cooking, the versatility of this method is enhanced by combining its effects with those obtained according to the parent applications. The presence of the low DOM dilution, from line 25, permits the further manipulation of not only sulfide ion concentration and sulfidity but also of dissolved organic material (DOM) concentration. By increasing the volume of dilution flow (from line 25) the sulfide ion concentration can be decreased. By increasing extraction flow (in line 17) the sulfide ion concentration can be increased, for a given dilution flow.

FIG. 2A schematically illustrates the decrease in effective alkali that occurs in the vessel 10 as the cooking process proceeds, the hydroxyl ion being consumed. FIG. 2B illustrates schematically the commensurate increase in sulfidity that occurs, which is a result of the consumption of the hydroxyl ion while the hydrosulfide ion is essentially unaffected.

FIG. 3 illustrates essentially the same digester 10 as in FIG. 1 only in this case the dilution-circulation/extraction loop 19' is operated so that the second zone, between the extraction screen 16 and the circulation/extraction screen 18, is a co-current cooking zone, as indicated by the unidirectional arrows 14, 15. In the FIG. 3 embodiment, the components of the loop 19' may be the same as for the loop 19 except that the re-introduction conduit 23' will re-introduce the withdrawn liquor having greater sulfidity and sulfide ion concentration than the liquor above the screen 16, immediately below the extraction screen 16, that is, adjacent the start of the co-current cooking zone. Also, in this embodiment, a dissolved organics removal mechanism 28 is illustrated in the extraction loop 19'. The mechanism 28 may be any of the mechanisms discussed in the parent applications, such as a filtration apparatus, e.g. ultrafiltration, with the discharged dissolved organics therefrom (such as hemicellulose and liginin) passing to recovery in line 27. Preferably, the apparatus 28 removes at least about half of the dissolved organics from the withdrawn liquor.

In the FIG. 3 embodiment, weak black liquor is also removed by extraction in line 17, but in this case it is replaced by stronger liquor introduced via line 23' near the top of the second zone (between screens 16, 18), and just below the screen 16. The liquor introduced at 23' was extracted at screen 18 after having its sodium hydroxide consumed during the co-current cook between screens 16, 18 in the second zone. The sulfide ion concentration can be manipulated by changing the dilution addition in line 25, the extraction in line 17, and the like.

In both the FIGS. 1 and 3 embodiments, the white liquor introduced in line 24, if provided, may have a sulfidity and a sulfide ion concentration more than 20% (e.g. more than 50%) greater than the sulfidity and of the cooking liquor above the screen 16, for example the white liquor at 24 being produced utilizing the recovery techniques as described in co-pending application Ser. No. 07/918,855 (atty. dkt. 30-199).

FIGS. 4A schematically illustrates the decrease in effective alkali that occurs in the vessel 10 of FIG. 3 as the cooking process proceeds, the hydroxyl ion being consumed. FIG. 4B illustrates schematically the commensurate increase in sulfidity that occurs, which is a result of the consumption of the hydroxyl ion while the hydrosulfide ion is essentially unaffected.

While FIGS. 1 and 3 show practice of this aspect of the invention in a continuous digester at an initial cooking zone, it is to be understood that an invention—including utilizing loops 19, 19' of FIGS. 1 and 3—is applicable to an impregnation zone in the continuous digester, a separate impregnation vessel, or indeed anywhere within the continuous digester where increased sulfidity and sulfide ion concentration compared to the prior art would be a benefit. Also conventional split-sulfidity techniques may also be employed, where a wide variety of different sulfidity cooking liquors are introduced at different points.

Figure 6:
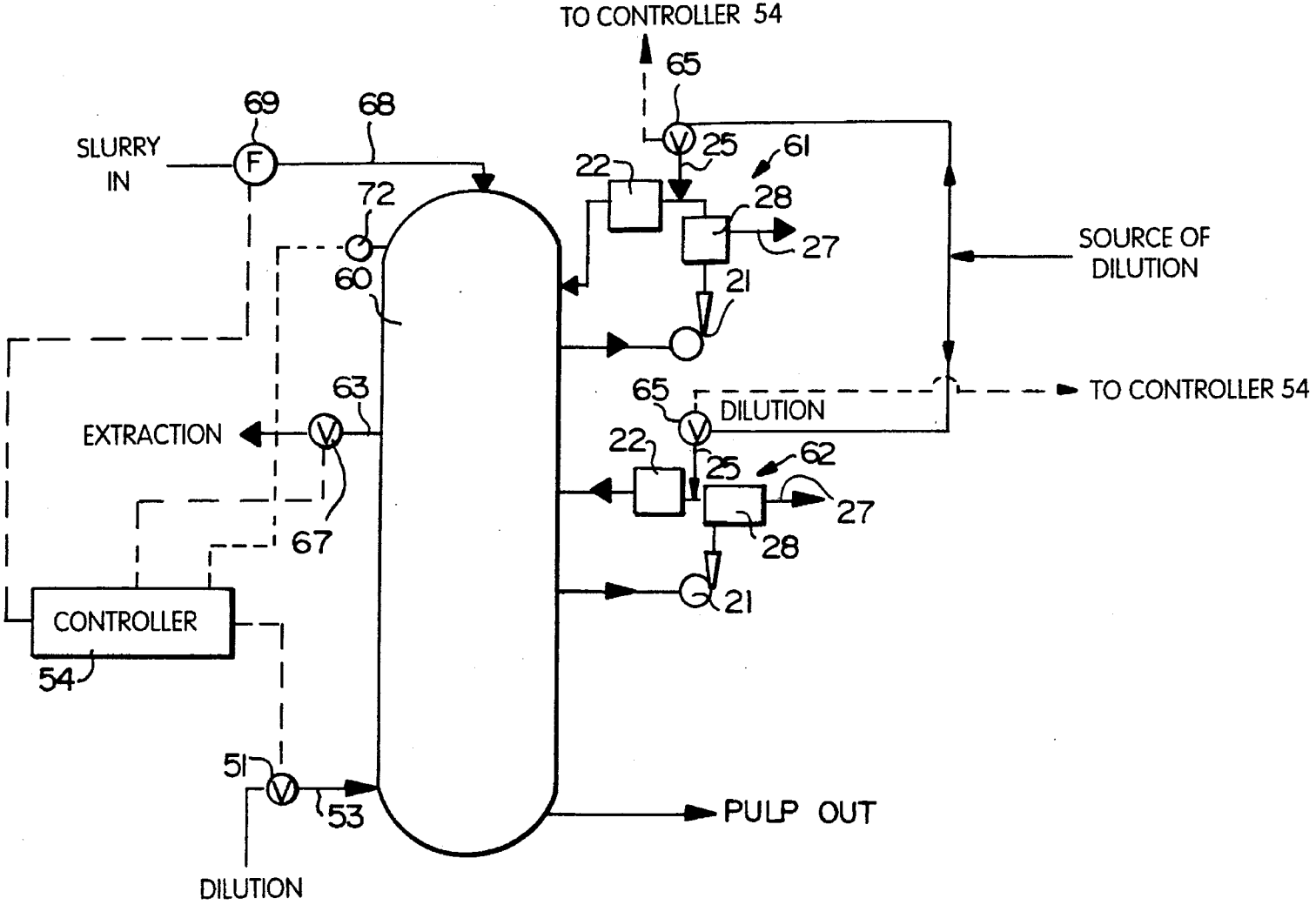
FIG. 6 is a side schematic view of an exemplary vertical continuous digester utilizing the method according to the present invention of controlling the pressure therein.

FIGS. 5 and 6 illustrate the pressure control aspect of the present invention. FIG. 5 schematically illustrates the bottom portion of a Kamyr® continuous digester 40 having wash screens 41, a central distribution chamber 42 with liquid discharge pipe 43, wash circulation header 44 which receives wash liquor from the screens 41 and recirculates it via conduit 45 and wash circulation pump 46 to a conventional wash heater, and then to the pipe 43. An outlet device 47 is also typically provided to facilitate movement of the digested pulp out of the digester 40 through the pulp outlet 48, the device 47 typically being driven by a direct drive 49.

For primary pressure control within the digester 40 the cold blow pump 50, and pressure control valve 51—known as "PV-11" in Kamyr® continuous digesters—are provided. Counter wash liquor is introduced into the bottom of the digester 40 via line 52 utilizing pump 50, while the majority of the washer flitrate pumped by the pump 50 flows through valve 51 to the digester dilution header 53. While the pressure can properly be controlled within the digester 40 by controlling the valve 51, as with a conventional controller 54 which receives pressure information from within the vessel 40, there is a drawback to this technique. This technique may result in fluctuations in liquor flow to the bottom of the counter-current cooking/washing zone in chamber 42. This may result in non-uniform liquor distribution and non-uniform column movement in a critical area, and may adversely affect the digester operation and the efficiency of treatment.

According to the present invention the problem described above is essentially eliminated, or at least greatly minimized. FIG. 6 schematically illustrates the invention in which the pressure within the continuous digester 60 is controlled. The pressure is primarily controlled in the digester 60 by controlling the amount of liquor withdrawn and introduced in the extraction/dilution loop 61, 62, which are distinct from the main extraction 63 (corresponding to the screen 16 and line 17 in FIG. 1). Each of the loops 61, 62 may be like the loop 19' illustrated in FIG. 2, including having a heater 22, pump 21, dissolved organics removal device 28, etc. By varying the amount of dilution liquor provided in the loops 61, 62 via the lines 25 (as by controlling the valves 65 utilizing the controller 54, or other components), and by controlling the amount of extraction removed via lines 27, the pressure in digester 60 is controlled.

While FIG. 6 illustrates two additional circulation/extraction-dilution loops 61, 62 (in addition to the main extraction 63 and the dilution header 53 associated with the valve 51), only one loop 61, 62 can be provided under some circumstances, or more than two loops under other circumstances. In any event, pressure control utilizing the loop or loops 61, 62 avoids non-uniform unstable material movement in the counter-current washing zone 42 of FIG. 5, and the loops 61, 62 can be provided wherever desired within the digester 60 to ensure proper column movement given the particulars of that digester.

While pressure control utilizing essentially only the loop or loops 61, 62 may be provided according to the present invention, again depending upon the particular digester 60, conventional pressure control techniques can additionally be utilized. For example, the valve 51 may still be controlled by the controller 54 to introduce digester dilution liquor below the wash screens (41 in FIG. 5), only because the volume of added liquor will be less than in the conventional digester, control will be better and there will be less disruptions to the chip column at the critical counter-current washing zone. Also, the controller 54 may control a valve 67 in the main extraction 63 to also control the pressure of the digester 60 that way. Also since the pressure in the vessel 60 is in some way dependent upon the amount of chips and liquor fed to the top of the digester in line 68, the controller 54 may also control a flow controlled mechanism 69 in the line 68, only this would be used in only special circumstances.

The pressure in digester 60 is typically controlled so that it is about 130–170 psi (e.g. about 165 psi), which pressure is sensed by pressure indicator 22, which provides an input to the controller 54.

While illustrated primarily with respect to hydraulic digesters, the invention is also applicable to other types (e.g. steam phase) of conventional continuous digesters.

It will thus be seen that according to the present invention various methods have been provided which increase the efficiency of kraft cooking, particularly in continuous digesters. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and processes.

What is claimed is:

1. A method of selectively increasing the sulfide ion concentration and sulfidity of kraft cooking liquor during kraft cooking of comminuted cellulosic fibrous material, comprising the steps of continuously:

(a) in a first treatment zone in which impregnation or kraft cooking of comminuted cellulosic fibrous material takes place, causing the material in a slurry of kraft cooking liquor having a first sulfide ion concentration and sulfidity to flow in a first direction through the first zone, from the beginning of the first zone to the end of the first zone;

(b) extracting black liquor from the material at some point after the first treatment zone;

(c) also at some point after the first treatment zone and distinct from step (b), withdrawing liquid from the material, and adding dilution liquid to the withdrawn liquid, and re-introducing the withdrawn liquid with dilution liquid to the material; and (d) in a second treatment zone after the first zone subjecting the material to a second kraft cooking liquor having a second sulfide ion concentration and sulfidity greater than the first sulfide ion concentration and sulfidity, including by manipulating and controlling the flow rate of extraction in step (b) and the flow rates of withdrawal of liquid and addition of dilution liquid in step (c), wherein steps (b) through (d) are practiced so that the second cooking liquor has a second sulfide ion concentration and sulfidity at least about 20% greater that the first sulfide ion concentration and sulfidity.

2. A method as recited in claim 1 wherein steps (b)–(d) are practiced so that the second sulfide ion concentration and sulfidity are about 20–50% greater than the first sulfide ion concentration and sulfidity.

3. A method as recited in claim 2 wherein during the practice of step (c) at least half of the dissolved organics are removed from the withdrawn liquor prior to re-introduction.

4. A method as recited in claim 2 wherein the first zone is a vertical co-current cooking or impregnation zone above an extraction screen in a vertical continuous digester, and wherein step (c) is practiced so that the reintroduced liquor flows primarily countercurrent to cellulosic material in a second zone in the vertical continuous digester, below the first zone.

5. A method as recited in claim 2 wherein the first zone is a vertical co-current cooking or impregnation zone above an extraction screen in a vertical continuous digester, and wherein step (c) is practiced to re-introduce the liquid adjacent the beginning of a second co-current zone, just below the extraction screen in the vertical continuous digester.

6. A method as recited in claim 1 wherein during the practice of step (c) at least half of the dissolved organics are removed from the withdrawn liquor prior to re-introduction.

7. A method as recited in claim 1 wherein the first zone is a vertical co-current cooking or impregnation zone above an extraction screen in a vertical continuous digester, and wherein step (c) is practiced so that the reintroduced liquor flows primarily countercurrent to cellulosic material in a second zone in the vertical continuous digester, below the first zone.

8. A method as recited in claim 1 wherein the first zone is a vertical co-current cooking or impregnation zone above an extraction screen in a vertical continuous digester, and wherein step (c) is practiced to re-introduce the liquid adjacent the beginning of a second co-current zone, just below the extraction screen in the vertical continuous digester.

9. A method as recited in claim 1 wherein the first zone is an impregnation zone of a continuous digester, or in an impregnation vessel connected to a continuous digester.

10. A method as recited in claim 1 utilizing a vertical continuous comminuted cellulosic fibrous material digester having a countercurrent washing zone with wash screens, a major extraction, and at least one additional extraction-dilution loop distinct from the main extraction; and comprising the further step (e) withdrawing liquor from, and introducing liquor into, the digester at the at least one additional extraction-dilution loop to maintain the pressure in the digester at a desired superatmospheric level while avoid non-uniform, unstable material movement in the countercurrent washing zone.

11. A method of selectively increasing the sulfide ion concentration and sulfidity of kraft cooking liquor during kraft cooking of comminuted cellulosic fibrous material, comprising the steps of continuously:

(a) in a first treatment zone in which impregnation or kraft cooking of comminuted cellulosic fibrous material takes place, causing the material in a slurry of a first kraft cooking liquor having a first sulfide ion concentration and sulfidity to flow in a first direction through the first zone, from the beginning of the first zone to the end of the first zone;

(b) at the end of the first zone removing a substantial amount of the first cooking liquor;

(c) in a second zone, following the first zone, causing the material to flow counter-currently to the flow of cooking liquor; and (d) at the beginning of the second zone introducing the material to a second cooking liquor having a higher sulfide ion concentration and sulfidity than the first liquor wherein steps (a) through (d) are practiced so that the second cooking liquor has a second sulfide ion concentration and sulfidity at least about 20% greater than the first sulfide ion concentration and sulfidity.

12. A method as recited in claim 11 wherein steps (a)–(d) are practiced so that the second cooking liquor has a sulfide ion concentration and sulfidity about 30–40% greater than the first sulfide ion concentration and sulfidity.

13. A method as recited in claim 12 wherein the first zone is an impregnation zone of a continuous digester, or in an impregnation vessel connected to a continuous digester.

14. A method as recited in claim 11 wherein the first zone is an impregnation zone of a continuous digester, or in an impregnation vessel connected to a continuous digester.

* * * * *